US005143600A

United States Patent [19]

Leiponen et al.

[11] Patent Number: 5,143,600

[45] Date of Patent: Sep. 1, 1992

[54] APPARATUS FOR FEEDING AIR INTO A FLOTATION CELL

[75] Inventors: Matti O. Leiponen, Espoo; Launo L. Lilja; Valto J. Mäkitalo, both of Pori, all of Finland

[73] Assignee: Outokumpu Oy, Helsinki, Finland

[21] Appl. No.: 639,040

[22] Filed: Jan. 9, 1991

[30] Foreign Application Priority Data

Jan. 10, 1990 [FI] Finland ..... 900123

[51] Int. Cl.[5] ..... B03D 1/16; B01F 3/04

[52] U.S. Cl. ..... 209/169; 261/93; 210/219; 210/221.1; 366/102

[58] Field of Search ..... 261/93; 209/169; 210/219, 220, 221.1; 366/102

[56] References Cited

U.S. PATENT DOCUMENTS

| | | | |
|---|---|---|---|
| 2,875,897 | 3/1959 | Booth | 209/169 |
| 3,437,203 | 4/1969 | Nakamura | 209/169 |
| 3,791,104 | 2/1974 | Clitheroe | 209/169 |
| 4,643,852 | 2/1987 | Koslow | 209/170 |

FOREIGN PATENT DOCUMENTS

| | | | |
|---|---|---|---|
| 967580 | 10/1982 | U.S.S.R. | 209/169 |
| 990315 | 1/1983 | U.S.S.R. | 209/169 |
| 2000038 | 1/1979 | United Kingdom | 261/93 |
| 2039763 | 8/1980 | United Kingdom | 209/169 |

*Primary Examiner*—Stanley S. Silverman
*Assistant Examiner*—Thomas M. Lithgow
*Attorney, Agent, or Firm*—Brooks Haidt Haffner & Delahunty

[57] ABSTRACT

The invention relates to an apparatus for feeding air into a flotation cell provided with a rotor and a stator. According to the method and apparatus of the present invention, air is fed into the intermediate space formed in between the rotor and stator covers, to above the rotor, wherefrom the air is distributed symmetrically.

13 Claims, 1 Drawing Sheet

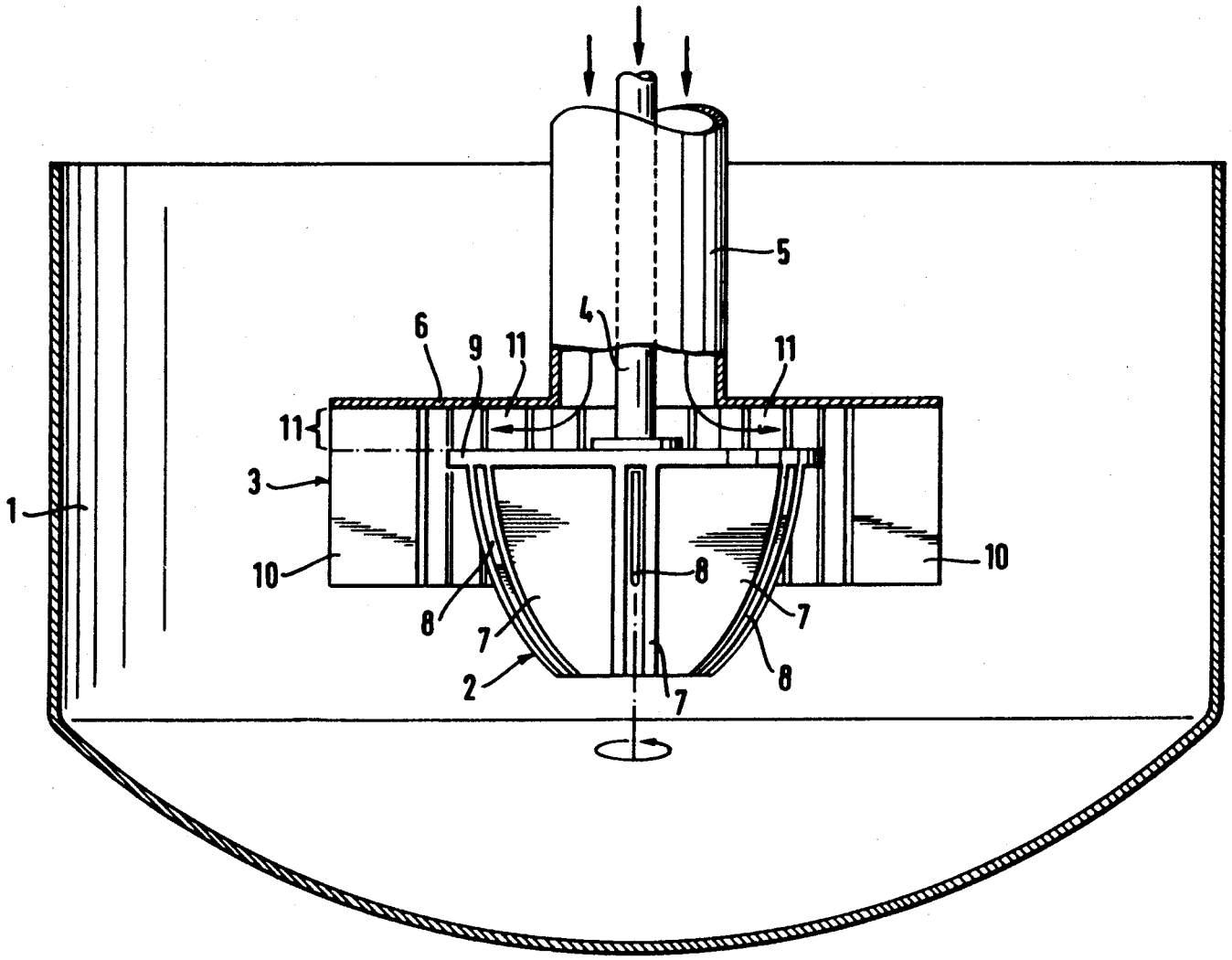
1
2
3
4
5
6
7
8
9
10
11

APPARATUS FOR FEEDING AIR INTO A FLOTATION CELL

The present invention relates to a method and apparatus for feeding air into a flotation cell provided with a rotor and a stator. According to the method and apparatus of the present invention, air is fed into the intermediate space formed in between the covers of the rotor and the stator, above the rotor, wherefrom the air spreads in a symmetrical fashion.

In the prior art there are known for example the flotation mechanisms introduced in the U.S. Pat. Nos. 4,078,026 and 4,800,017, which comprise a rotor and a stator, and where air is fed through a hollow shaft to inside the rotor, wherefrom it flows out through slurry ducts and aerates the slurry. In both of these U.S. patents, the stator blades of the mechanism are supported against each other by means of a supporting ring, which extends. when seen from the top, to the area of the disc formed by the stator blades.

The Swedish patent publication 398,978 describes a flotation apparatus where around the shaft of a blade mixer there is placed a pipe through which air is sucked into the flotation cell. Around the mixer there is a diffuser with a cover, which diffuser is at its outer edge provided with plates that are arched when observed from the top. On the bottom of the flotation cell, there are placed plates projected in a curved fashion outwards, from the center of the cell towards the periphery thereof, the purpose of which plates is to increase the amount of air sucked in. A similar type of apparatus is also introduced in the SE patent 398,826, but without the plates that regulate the air intake. This blade mixer is not provided with a special cover, but air is mixed with the slurry in similar fashion as the air conducted from within the rotor into the slurry ducts thereof.

The patent publication DE-AS 1,209,971 describes a cell of the Fagergren type, where both the rotor and the stator are formed of blades arranged in a ring. Air is conducted into the cell from around the rotor shaft, and it flows into the space inside the rotor blades through the top part of the rotor.

The U.S. Pat. Nos. 2,865,618 and 3,506,120 also describe feeding of air into the space above the rotor, in between the rotor and the stator, but in both cases the feeding is carried out eccentrically.

The drawback with the flotation mechanisms described above has been that particularly when the cells have been large and the material to be flotated coarse, the air fed through the inside of the rotor has at least partly filled the slurry ducts. As a consequence, the pumping capacity of the rotor has weakened. This has been proved for instance by the fact that the rotor has not been capable of keeping all solid material in suspension, but part of the solids has descended on the bottom of the tank. Similarly the hold-up contained in the slurry has been reduced. By means of the now developed new air feeding apparatus and method, the pumping capacity of the rotor is essentially raised; thus the slurry containing even coarse material can be maintained in suspension, and at the same time the hold-up of the slurry becomes essentially larger than before.

BRIEF DESCRIPTION OF THE DRAWING

The new air feeding apparatus for a flotation cell is described in more detail in the appended drawing 1, which is a vertical cross-section of a preferred embodiment of the apparatus of the invention.

FIGURE illustrates a flotation mechanism placed in the cell 1, which mechanism comprises a rotor 2 and a stator 3. The rotor is suspended from the shaft 4, and air is fed into the mechanism through the air supply pipe 5 located centrically around the shaft 4. The air supply pipe is fastened to the stator cover 6, which is open at the pipe 5, but otherwise closed. Air can of course be fed in other ways than from around the shaft, but it is advantageous that the feeding takes place in a symmetrical fashion. One such symmetrical feeding method is to feed air through several separate supply conduits. The rotor 2 is advantageously formed of the rotor blades 7, that are projected radially or in a roughly radial direction from the center outwards, and of the slurry ducts 8 left in between the blades, as well as of the cover plate 9, which is at least as large as the outer diameter of the top part of the rotor blades. The cover plate can also be somewhat larger than by the circle defined by the tops of outer edges of the rotor blades as shown in the drawing, but not more than 20% larger.

According to the spirit of the invention, the rotor can be of some other shape, too, but the essential point is that it includes a uniform cover member which prevents air from flowing into the slurry ducts. According to the drawing, the stator is formed of the said cover member 6 and of the stator blades 10 that are projected essentially downwards from the cover. Advantageously the stator blades do not extend down to the bottom, but the rotor blades 7 reach further down than the stator blades 10. The stator can also be of some other shape, but in practical experiments the above described form has been found advantageous. In the vertical direction the stator is placed at least partly higher up than the rotor, so that in between the stator cover and the rotor cover there remains an air distribution duct 11, whereto the supplied air is conducted to flow and to be evenly discharged therefrom to around the rotor. It is essential that on the horizontal plane the stator cover 6 extends clearly further out than the rotor cover 9, advantageously at least a length that is 0.2 times the diameter of the rotor. In the experiments that were carried out it was found that the distance in between the stator and rotor covers, i.e. the height of the air distribution duct, should be as short as possible, generally 2–20% of the diameter of the rotor cover, advantageously 7–12% of the diameter of the rotor cover.

Generally the most advantageous arrangement is to install the flotation mechanism in the flotation cell so that the rotor and stator covers are placed horizontally, but if particular reasons arise, the flotation mechanism can also be placed in an inclined position with respect to the cell, so that the rotor and stator covers are still parallel, but form an angle with the horizontal plane, the maximum of this angle being 30°. Neither is it necessary that the rotor and stator covers be mutually parallel, but in some cases they can be divergent, so that the height of the air distribution duct remaining in between the covers is either widened or narrowed while proceeding towards the outer periphery of the rotor. In practice this is achieved by means of the design of the rotor cover.

According to this new arrangement air is fed to above the rotor, and therefore the rotor slurry ducts are not filled with air anymore, but the rotor is capable of mixing the slurry to its full effect. However, the turbulence created by the rotor is effectively utilized at the outer edge of the rotor cover, where air is mixed into the slurry pumped by the rotor and broken up into small bubbles. Thus the slurry discharged from the slurry ducts is effectively mixed with the air fed in from around the rotor. One value that describes the efficiency of the flotation is the hold-up of the slurry, and it has been found out that according to the method of the present invention, this hold-up can be essentially increased with respect to the flotation mechanisms operated in the previously known fashion.

As a conclusion, the advantages of the method and apparatus of the present invention can be listed as follows:

By employing the apparatus, there is achieved an effective pumping irrespective of the amount of air used, in which case the slurry density and grain size gradient also remain evenly small throughout the cell volume. This has an extremely positive effect with respect to the success of the flotation.

The meeting of bubbles and mineral particles is extremely efficient outside the rotor, both in the stator and already in the intermediate space before that. This is a basic prerequisite for the flotation process, and increases the yield of precious metals.

In this embodiment sanding has been eliminated, and thus the whole of the cell volume is in efficient use. Consequently the apparatus is capable of treating slurries containing even coarse grains without operational disturbances.

The air feeding method without of the invention is practical also when the flotation mechanism is applied to the aeration of waste waters.

In certain cases the stator cover can be replaced with plates attached to the shaft or to the rotor, in which case air is fed in between the said plate and the rotor cover. This method is advantageous particularly when the stator plates are desired to be placed in conventional fashion on the same level with the rotor blades, or lower, or if the stator blades are desired to be taken further to the circumference of the flotation cell.

We claim:

1. An apparatus for feeding air into a flotation mechanism, wherein the apparatus comprises a stator and rotor each provided with a generally disc-shaped top cover, said disc-shaped stator top cover having a larger diameter than said disc-shaped rotor top cover and said stator top cover being concentrically positioned above and adjacent to said rotor top cover thereby defining an air distribution duct between said top covers, said rotor top cover having a plurality of rotor blades extending vertically downwardly from said rotor top cover and said stator top cover having a plurality of stator blades extending vertically downwardly therefrom to below the top cover of the rotor, air supply means comprising an air supply pipe having its lower end attached to a central opening in said stator top cover thereby communicating with said air distribution duct, said air supply pipe diameter being substantially smaller than said rotor top cover diameter and means to rotate said rotor.

2. The apparatus of claim 1, wherein the height of the air distribution duct is 2–20% of the diameter of the rotor top cover.

3. The apparatus of claim 1 or 2 wherein the diameter of the rotor top cover is larger than that of a circle drawn about top outer edges of said rotor blades of the rotor.

4. The apparatus of claim 3, wherein the rotor top cover is at the most 20% larger than a circle drawn about the top outer edges of rotor blades.

5. The apparatus of claims 1 or 2 wherein the diameter of the rotor top cover is of the same size as that of a circle drawn about top outer edges of the rotor blades.

6. The apparatus of claim 1 or 2 wherein the vertical direction the rotor blades reach further down than the stator blades.

7. The apparatus of claim 1 or 2 wherein both the stator top cover and the rotor top cover are placed horizontally.

8. The apparatus of claim 1 or 2 wherein the stator top cover and the rotor top cover are placed in parallel direction, and that they form an angle, maximum 30°, with respect to the horizontal level.

9. The apparatus of claim 1 or 2 wherein the stator top cover and the rotor top cover are placed in divergent directions, so that the height of the air distribution duct left in between them increases while proceeding towards the outer periphery of the rotor.

10. The apparatus of claim 1 or 2 wherein the stator top cover and the rotor top cover are placed in divergent directions, so that the height of the air distribution duct left in between them decreases while proceeding towards the outer periphery of the rotor.

11. The apparatus of claim 1 or 2 wherein the air supply pipe is placed concentrically around a rotor shaft.

12. The apparatus of claim 1 wherein the height of the air distribution duct is 7–12% of the diameter of the rotor top cover.

13. The apparatus of claim 1, 2 or 12 wherein the diameter of the stator top cover is about 1.2 times the diameter of the rotor top cover.

* * * * *

UNITED STATES PATENT AND TRADEMARK OFFICE

CERTIFICATE OF CORRECTION

PATENT NO. : 5,143,600

DATED : September 1, 1992

INVENTOR(S) : Matti O. Leiponen et al

It is certified that error appears in the above-identified patent and that said Letters Patent is hereby corrected as shown below:

Column 2, line 20:

"larger than by the circle" should read:

--larger than the circle--.

Column 3, line 30:

"method without of the invention is" should read:

--method of the invention is--.

In the claims, column 4, line 44:

should read: --shaft, said shaft being a part of said means to rotate said rotor--.

Signed and Sealed this

Nineteenth Day of October, 1993

*Attest:*

*Attesting Officer*

BRUCE LEHMAN

*Commissioner of Patents and Trademarks*